US006640887B2

(12) United States Patent
Abell et al.

(10) Patent No.: US 6,640,887 B2
(45) Date of Patent: Nov. 4, 2003

(54) TWO PIECE HEAT EXCHANGER MANIFOLD

(75) Inventors: Bradley D. Abell, Baltimore, MI (US); Richard G. Gibbons, Harsens Island, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/742,708

(22) Filed: Dec. 20, 2000

(65) Prior Publication Data

US 2002/0074113 A1 Jun. 20, 2002

(51) Int. Cl.[7] ..... F28F 9/02

(52) U.S. Cl. ..... 165/175; 165/173; 165/178; 29/890.043; 29/590.052

(58) Field of Search ..... 165/173, 178, 165/175, 176; 29/890.052, 890.43

(56) References Cited

U.S. PATENT DOCUMENTS

| | | | | | |
|---|---|---|---|---|---|
| 3,741,849 | A | * | 6/1973 | Hardy | 165/173 X |
| 4,386,652 | A | * | 6/1983 | Dragojevic | 165/176 X |
| 4,615,385 | A | * | 10/1986 | Saperstein et al. | 165/175 |
| 4,829,780 | A | * | 5/1989 | Hughes et al. | 165/176 X |
| 4,960,169 | A | * | 10/1990 | Granetzke | 165/173 |
| 4,971,145 | A | * | 11/1990 | Lyon | 165/173 |
| 5,052,480 | A | * | 10/1991 | Nakajima et al. | 165/173 |
| 5,076,354 | A | | 12/1991 | Nishishita | |
| 5,107,926 | A | * | 4/1992 | Calleson | 165/173 |
| 5,251,694 | A | * | 10/1993 | Chigira | 165/173 |
| 5,259,449 | A | * | 11/1993 | Case | 165/173 |
| 5,327,959 | A | * | 7/1994 | Saperstein et al. | 165/173 |
| 5,329,995 | A | * | 7/1994 | Dey et al. | 165/153 |
| 5,450,896 | A | | 9/1995 | Bertva et al. | |
| 5,816,321 | A | | 10/1998 | Wijkstrom | |
| 5,836,384 | A | | 11/1998 | Wijkstrom et al. | |
| 5,873,409 | A | | 2/1999 | Letrange et al. | |
| 5,898,996 | A | * | 5/1999 | Buchanan et al. | 29/890.052 |
| 5,904,206 | A | | 5/1999 | Kroetsch | |
| 5,918,667 | A | | 7/1999 | Chiba et al. | |
| 5,947,196 | A | | 9/1999 | Halm et al. | |
| 6,155,340 | A | * | 12/2000 | Folkedal et al. | 165/175 |
| 6,176,303 | B1 | * | 1/2001 | Kobayashi et al. | 165/175 |

FOREIGN PATENT DOCUMENTS

| | | | | |
|---|---|---|---|---|
| DE | 4305060 | * | 8/1994 | 165/176 |

* cited by examiner

*Primary Examiner*—Leonard Leo
(74) *Attorney, Agent, or Firm*—Brinks Hofer Gilson & Lione

(57) ABSTRACT

A heat exchanger manifold for use in heat exchanger used mainly in automobiles is provided. The manifold comprises of two components a header and tank. The header consists of several half cylinders that have ferrule openings and communication port stamped on them. The communication ports are in form of channels that coincide with the ferrule opening. The ferrule openings allow the heat exchanger tubes to slide into the manifold and without any interference. The second component of the manifold comprises a tank. Like the header the tank also consists of several half cylinders, which combined with the header forms several full cylinder. The tank also includes an integral seal along the mating end of the manifold. The manifold also contains a unique inlet/outlet port that allows for ease of assembly of the final heat exchanger.

17 Claims, 5 Drawing Sheets

TWO PIECE HEAT EXCHANGER MANIFOLD

TECHNICAL FIELD OF THE INVENTION

This invention generally relates to a heat exchanger capable of withstanding high-pressure application. More specifically, this invention relates to a metal heat exchanger manifold to be used in automobiles where the manifold has an integral inlet/outlet port and a 360° seal around the manifold.

BACKGROUND OF THE INVENTION

Heat exchangers of the type, which are typically employed in air conditioning systems for automobiles, comprise separated manifolds with a large number of heat exchange tubes which carry coolant fluid between the manifolds. Traditional heat exchanges also comprise inlet and outlet tubes which are separately secured to the manifold.

In typical heat exchangers, each manifold comprises a tubular body that is internally divided by partitions or walls into a plurality of compartments to define a path for the coolant fluid through the heat exchange tubes. In addition to allow coolant to flow freely, it is also desirable for such manifolds to withstand high pressure. Such manifolds may be formed of two channel-like half shell, which are joined together along their longitudinal edges to form the manifold, with the partitions located transversely within the manifold. However, with such an assembly, difficulties arise in accurately locating the partitions or wall members within the manifold. If these are not accurately located, problems of leaking of the manifold can arise, as well as problems of partial obstructions of the heat exchange openings.

In order to accurately locate the partitions inside the manifold, it is known to seat these partitions in circumferential grooves machined on the internal surfaces of the tank and header part, which serve to position the partitions longitudinally therein. However, the problem with this arrangement is that in forming the grooves, the wall of the tank material is liable to deform, and in particular to elongate so that the intended groove locations cannot be accurately maintained.

Another method know in the art to provide a path for the coolant is to provide the tank part with seating slots extending entirely through the wall thickness into which the partitions are laterally fitted from outside of the manifold. However, in this method it is difficult to accurately locate the slots at the desired positions. Moreover, the slots provide additional possible leakage paths for coolant fluid. Prior art techniques have also disclosed a tubular manifold in which the partitions are held in position by deforming the tubular manifold wall on either side of the partitions by applying a circumferential beading. Other prior art technique have provided for insertion of baffles inside the manifold.

As is well known in the art, the coolant flows through the heat exchanger tubes that are typically inserted in the manifold. In order to insert heat exchange tubes into the manifold to facilitate the flow of coolants, slots are cut in the manifold. The heat exchanger tubes are then inserted to the slots. To seal the open ends of the manifold, end caps are provided that will prevent the coolant from leaking. However, these techniques have resultant in substantial leaking of the coolant through these slots.

A typical heat exchanger is assembled by inserting the heat exchanger tubes in the slots, the input and output tubes are then positioned and the end caps are positioned to cover the open end. The assembly is then brazed to bond the various components together. Therefore, the prior art techniques of assembling the heat exchanger involved accurate positioning of the various components to enable bonding of the components together. This technique was not only tedious but also involved manufacturing of separate components.

In view of the above, it is become desirable to provide a new design for the heat exchange manifold that allows for easy assembly of the heat exchanger. There is also a need to provide for a heat exchanger that can be brazed with ease and can with stand high pressure application.

BRIEF SUMMARY OF THE INVENTION

Accordingly, this invention provides for a two-piece heat exchanger manifold that overcomes the problems and disadvantages of the conventional heat exchangers known in the art. The invention provides for a heat exchanger comprising a two-piece manifold and heat exchanger tubes coupled to the manifold.

In accordance with the teaching of the present invention, the manifold comprises of two parts: the header and the tank. In one aspect of the invention the header, consists of several half cylinders formations that are stamped on a sheet of metal. Another aspect of the present invention provides for communication ports that are stamped on the header of the manifold. The communication ports in the present invention are in the form of channels that allow the coolant to flow and mix through out the manifold.

Yet another aspect of the present invention is the presence of another set of half cylinder formation disposed perpendicular to and intersecting the first set of half cylinders. The ferrule openings are cut in the base of the second set of half cylinder. The ferrule openings are cut such that they coincide with the communication channels in the header of the manifold. The ferrule opening allows for a heat exchanger tube to slide inside the manifold and also help in the ease of brazing.

The invention also provides for a tank that consists of several other half cylinder formations which when combined with the header half cylinder, form several complete cylinders. Yet another feature of the present invention is the presence of 360° seal around the mating edge of the manifold for better sealing between the header and the tank. This eliminates the need for the end caps or other sealing devices to mate the header and tank.

Yet another aspect of the present invention is the manifold consists of an integral inlet/outlet port that are stamped on the header and the tank. The integral input/output port allows for an easy assembly of the heat exchanger manifold in accordance with the teachings of the present invention.

BRIEF DESCRIPTION OF THE DRAWINGS

Further features and advantages of the invention will become apparent from the following discussion and accompanying drawings, in which.

DETAILED DESCRIPTION OF THE INVENTION

Figure 1:
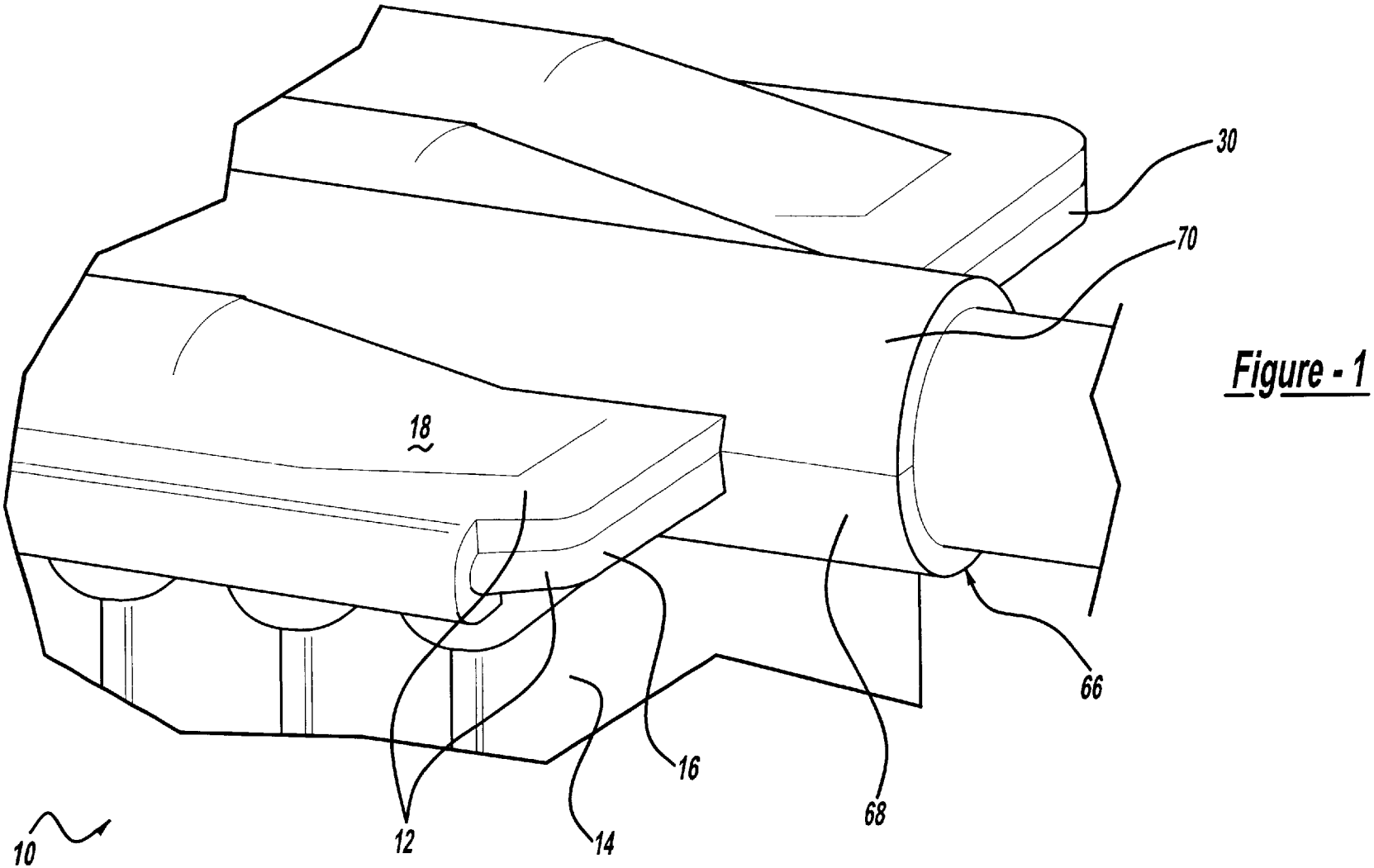
FIG. 1 is a side perceptive view of the header, tank, heat exchanger tube, an integral port and a 360° seal of a heat exchanger according to the preferred embodiment of the invention.

The following description of the preferred embodiment is merely exemplary in nature, and is in no way intended to limit the invention or its application or uses.

Referring in particular to the drawings, a heat exchanger 10 for use in automobiles is generally illustrated. The heat exchanger 10 comprises a manifold 12 and heat exchanger tubes 14 coupled to the manifold 12. Although in the drawings only one manifold assembly 12 is shown, it is possible to have a manifold assembly of similar design at each end of the heat exchanger tubes 14.

Figure 2:
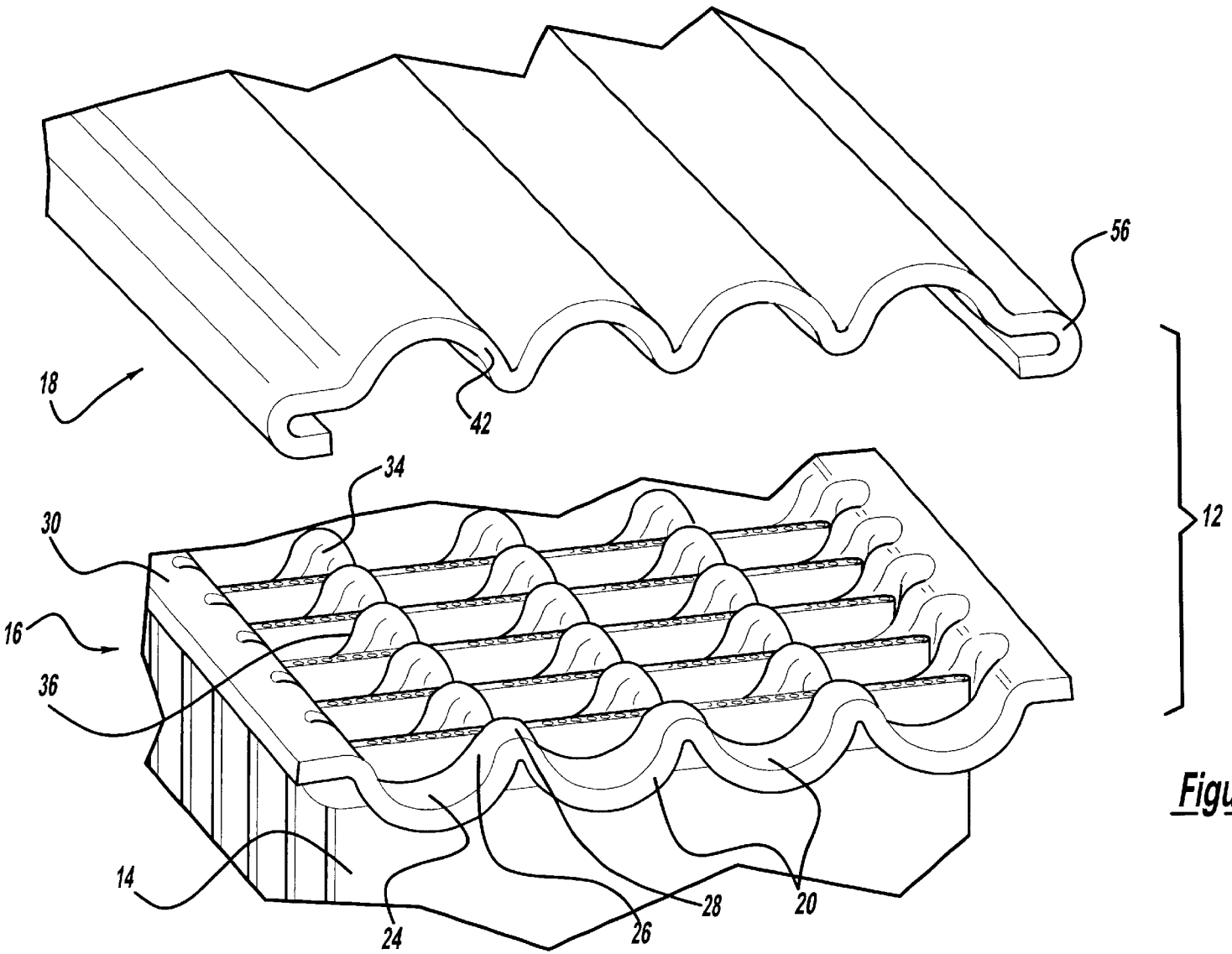
FIG. 2 is an exploded view of the header, tank and the heat exchanger tubes of a heat exchanger according to the preferred embodiment of the invention.

Referring in particular to FIG. 2, the manifold 12 in accordance with the teachings of the present invention is a two-piece component comprising of the header 16 and the tank 18. As will be discussed later, the header 16 and the tank 18 are brazed together using the well know techniques, to obtain the two-piece manifold 12.

With continued reference to FIG. 2, the header 16 consists of several half cylinders 20 that are stamped on a flat metal sheet. Each half cylinder 20 of the header 16 defines a base 24, curved walls 26 extending upward from the base 24. A flat wall 28 joins the adjacent curved walls 26 of each half cylinder cylinders 20. In the preferred embodiment the metal sheet is rectangular in shape and is formed from aluminum or aluminum alloy having a brazed material coated on both sides of the metal sheet. The header 16 also comprises an outwardly extending wall 30 that surrounds the half cylinder 20 of the header 16. In the preferred embodiment the outwardly extending wall 30 is at an elevated level when compared to the base 24 of the half cylinder 20 of the header 16.

Figure 3:
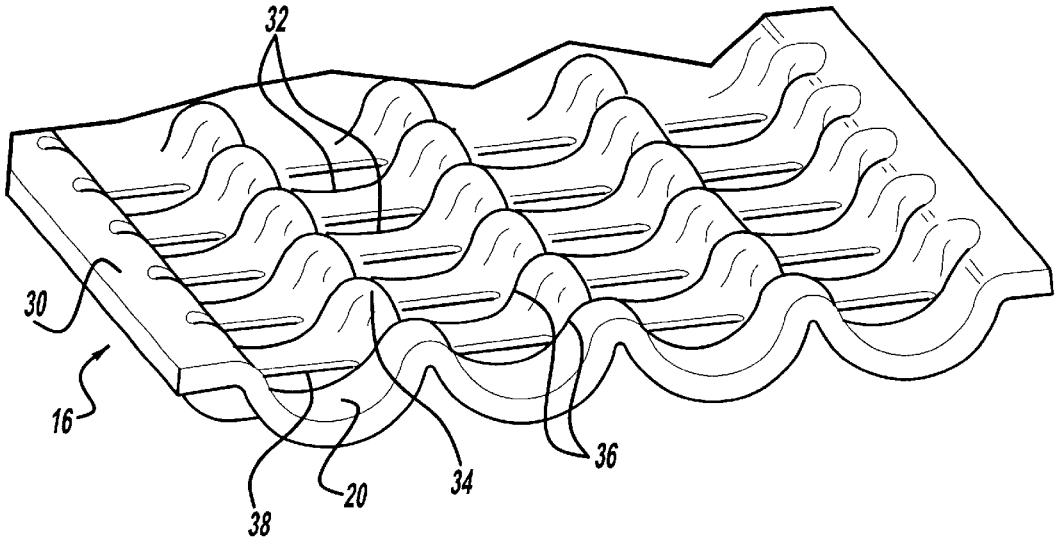
FIG. 3 is a top perceptive view of the header of a manifold in a heat exchanger according to the preferred embodiment of the invention.
Figure 4:
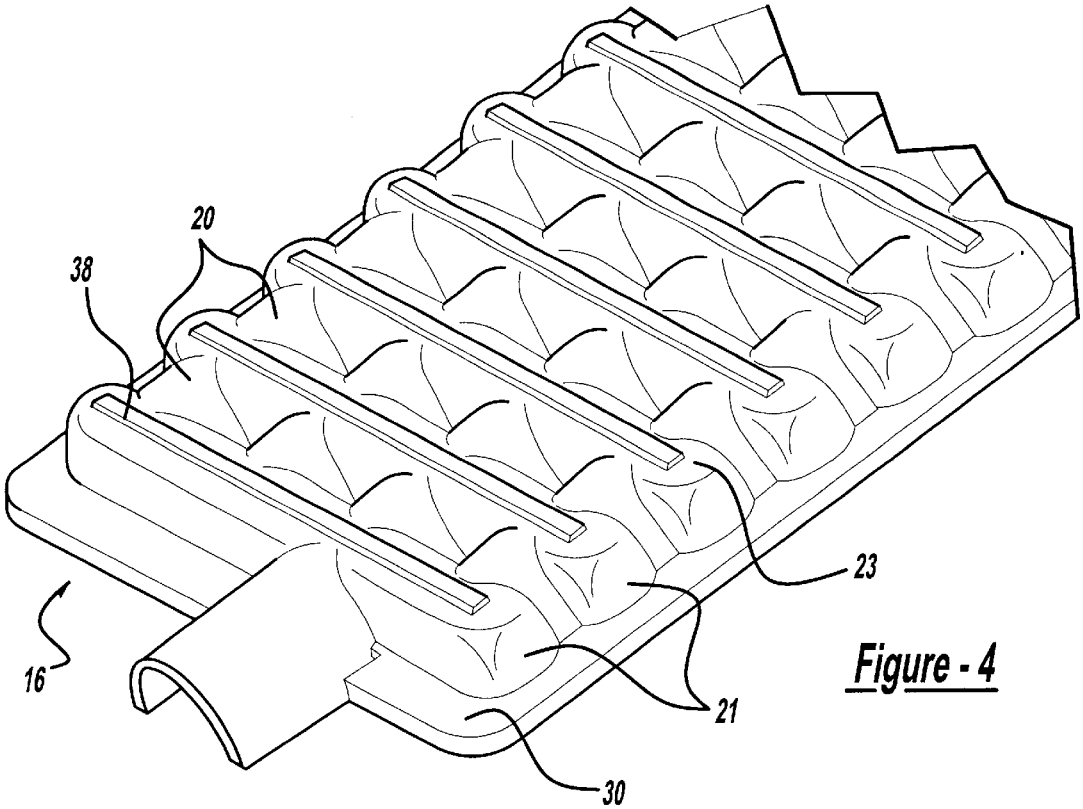
FIG. 4 is a bottom perceptive view of the header and the integral input/output port of a manifold assembly according to the preferred embodiment of the invention.

Referring in particular to FIGS. 3 and 4, the header 16 consists of another set of half cylinder 21 extending from the outwardly extending wall 30. The half cylinder 21 defines a base 23. In the preferred embodiment, half cylinders 21 formed are perpendicular to and intercept half cylinders 20 such that the bottom of the header 16 forms a web-like network.

As shown in FIG. 3, in order to allow the coolant to flow freely and smoothly throughout the manifold 12, the header 16 consists of several communication ports 32. In the preferred embodiment, the communication ports 32 are in the form of channels 32. Channels 32 are defined by stamping mounds or hills 34 at regular interval on the flat wall 28. Channels 32 are defined between the mounds 34. In the preferred embodiment the mounds 34 are stamped on the wall 28 and are flanked on either side by the upwardly extending wall 26.

Referring to FIGS. 2, 3 and 4, the heat exchanger 10 in accordance with the teachings of the present invention comprises heat exchanger tubes 14 coupled to the header 16 of the manifold 12. Therefore, it is important to insert the heat exchanger tuber 14 into the manifold 12 without any interference to the flow of coolant inside the manifold 12. As is well know in the art, during use of the heat exchanger 10, the heat exchanger tubes 14 are constantly pressing against the surface of the header 16 in the manifold 12.

With continued reference to FIGS. 2, 3 and 4, in order to achieve a good bond between the heat exchanger tubes 14 and the manifold 12, the header 16 is provided with ferrule openings 38. The ferrule opening 38, are cut in the base 23 of the second half cylinder 21 in the header 16. The ferrule opening 38 extend the entire length of the second half cylinder 21. The ferrule openings 38 are formed such that they are perpendicular to the longitudinal plane of the header 16. Further, the ferrule openings 38 are stamped on the base 23 such that they coincide with the communication port or channels 32. The ferrule opening 38 allows heat exchanger tubes 14 to slide inside the manifold 12 without interfering with the flow of coolants. Further, since the ferrule openings 38 are cut at the base of a half cylinder they assist the manifold in withstanding high-pressure application.

Figure 5:
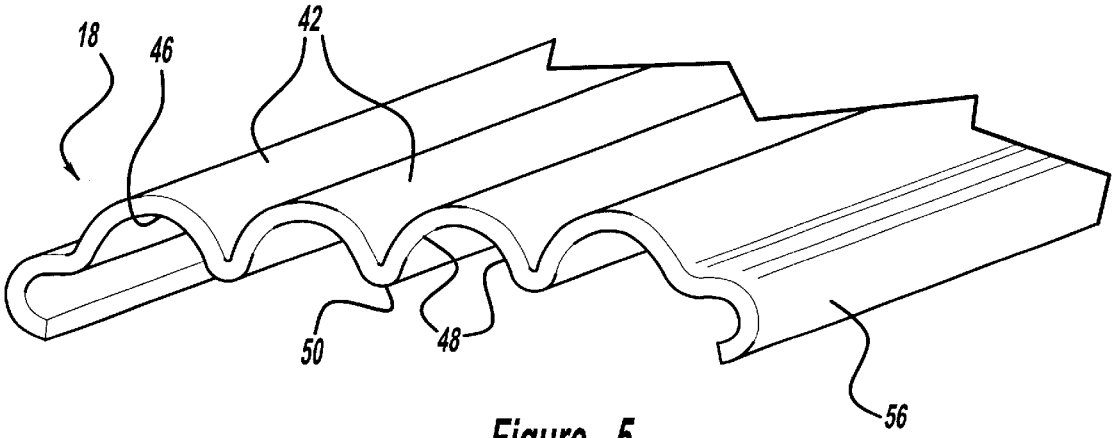
FIG. 5 is a top perceptive view of the tank of a manifold assembly according to the preferred embodiment of the invention.
Figure 6:
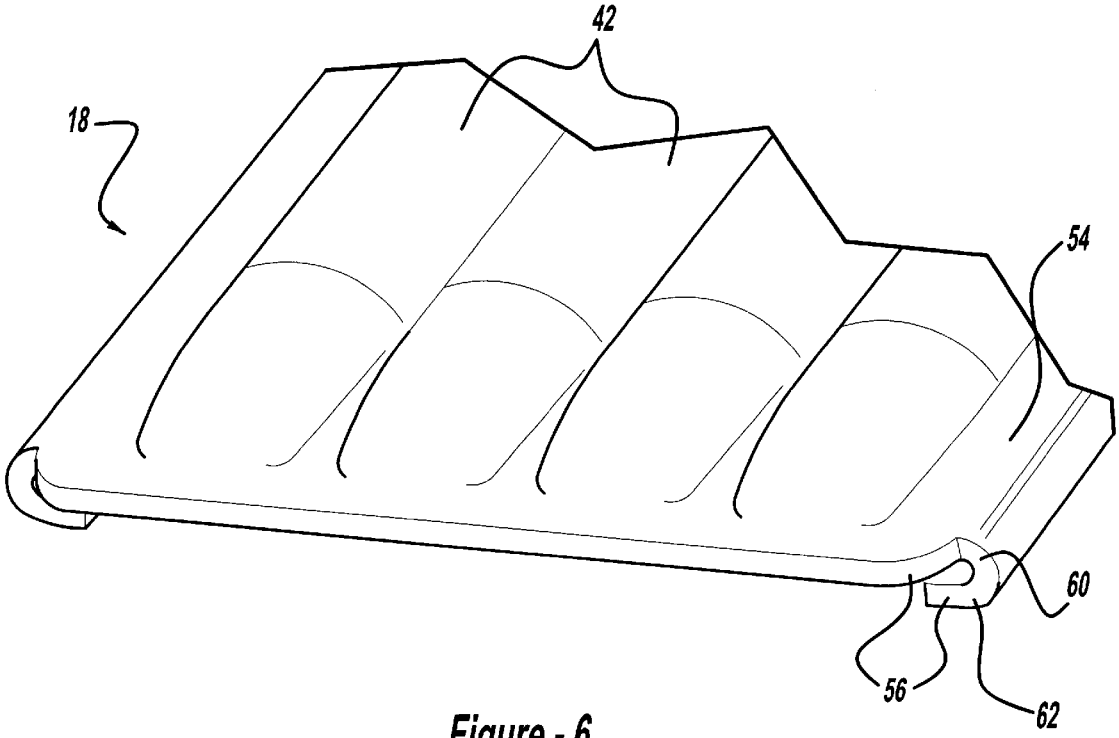
FIG. 6 is side perceptive view of the tank having an integral crimping mechanism of a manifold assembly according to the preferred embodiment of the invention.
Figure 7:
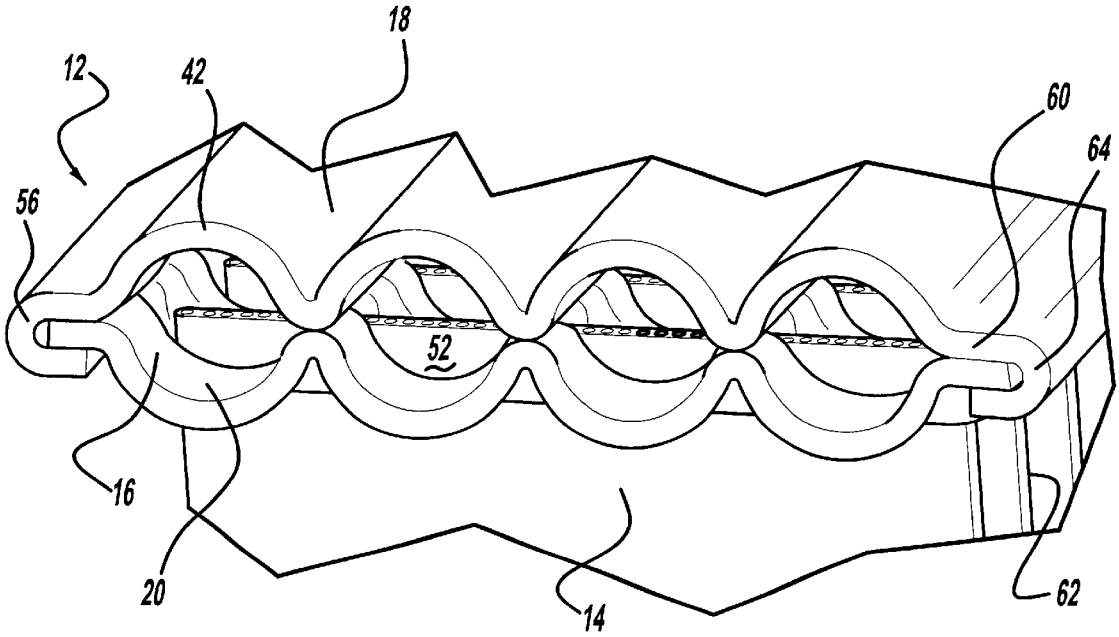
FIG. 7 is a partial front view of the manifold showing complete cylinder formed by joining the half cylinder of the header and the half cylinder of the tank and the heat exchanger tubes according to the preferred embodiment of the invention.

Referring in particular to FIGS. 5, 6, and 7, the second component of the manifold 12 is the tank 18. Like the header 16, the tank 18 also consists of several half cylinder 42 stamped on a flat metal sheet. Each half cylinder 42 stamped on the tank 18 has a base 46 and curved walls 48 extending outward from the base 46. A flat wall 50 joins the adjacent curved walls 48 of the half cylinder 42 of the tank 18. In the preferred embodiment, the tank 18 has the same dimension as the header 18. Therefore, the tank is rectangular in shape and is made of aluminum sheet with a brazing material coated on both sides of the aluminum sheet. As will be discussed later, in order to assemble the manifold 12, the tank 18 is placed above the header 16 such that the flat wall 50 of the tank sits on top of the mound 34 of the header 16.

As shown in FIG. 7, the half cylinder 20 of the header 16 and the half cylinder 42 of the tank 18 are configured such that when the half cylinders 42 of the tank 18 are combined with the half cylinder 20 of the header 16, complete cylinders 52 are formed.

With continued reference to the FIGS. 5 and 6, an outwardly extending wall 54 surrounds the half cylinders 42 of the tank 18. A crimping flange 56 extends from the edge of the outwardly extending wall 54 and is an integral part of the tank 18. In the preferred embodiment, the crimping flange 56 forms a channel. The crimping flange 56 consists of a curved wall 60, and a lower wall 62. The curved wall 60 extends outwardly and downwardly from the edge of the outwardly extending wall 54. The lower wall 62 is integrally attached to the curved wall 60 and is parallel to the outwardly extending wall 54. In the preferred embodiment, the distance between the outwardly extending wall 54 and the lower wall 62 is equal to the thickness of the outwardly extending wall 30 of the header 16. On assembly, the outwardly extending wall 30 of the header 16 slides between outwardly extending wall 54 and the lower wall 62 of the crimping flange 56. As will be discussed later, during the brazing process, the crimping flange 56 will form a tight seal around the edge of the manifold 12.

The manifold 12 in accordance with the teaching of the present invention also includes an integral inlet port 66. In FIG. 1 although only one port 66 is shown, the port 66 can function either as an input port or an output port. The input port 66 comprises a half cylinder 68 stamped on one of the outward extending walls 30 of the header 16. The half cylinder 68 of the input port 66 extends outward and away from the wall 30. The other half cylinder 70 of the input port 66 is stamped on the tank 18. When the half cylinder 68 on the header 16 is mated with the half cylinder 70 on the tank 18 the port 66 containing a complete cylinder is formed. The input port 66 is positioned such that the plane of the port 66 is parallel to the longitudinal axis of the header 16 and tank 18. The plane of port 66 is perpendicular to the heat exchanger tubes 14.

The heat exchanger 12 in accordance with the teachings of the present invention is assembled by placing the tank 18 on top of the header 16 such that the flat wall 50 of the tank 18 rests on top of the mounds 34 of the header 16. As mentioned above, when the half cylinders 42 of the tank 18 are combined with the half cylinder 20 of the header 18, they form several complete cylinders 52. The heat exchanger tubes 14 are then inserted into the ferrule openings 38. Aligning the half cylinder 68 with the half cylinder 70 forms the integral port 66. The heat exchanger assembly comprising the header 16, tank 18 and heat exchanger tubes 14 are brazed in an oven for a predetermined amount of time. Upon brazing the crimping flange 56 forms a 360-degree seal along the mating edge of the manifold 12. The present design of the manifold eliminates the need for a separate end cap since the crimping mechanism forms a seal around the mating edge of the header and tank. Also, since the inlet port 66 is integral with the manifold 12, there is ease in assembly of the heat exchanger.

Once the heat exchanger is assembled, coolant enters the manifold 12 through the inlet port 66. Due to presence of channels, the coolant flows through the manifold 12 without any interferences. The coolant then passes through the heat exchanger tubes 14 and is discharged through the outlet port (not shown).

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

We claim:

1. A two piece heat exchanger manifold for a vehicle comprising:

a header wherein said header is formed of a first set of half cylinders;

an upwardly extending wall joining said first set of half cylinders;

an outwardly extending header wall surrounding said first set of half cylinders;

a tank coupled on top of said header wherein said tank is formed of a second set of half cylinders;

an outwardly extending tank wall surrounding said second set of half cylinders;

said header further comprising a third set of half cylinders extending from said outwardly extending header wall, wherein said third set of half cylinders are perpendicular to and intercepts said first set of half cylinders;

said third set of half cylinders having a single ferrule opening, wherein said ferrule opening substantially extends between opposing said outwardly extending header walls along a substantial length of said third set of half cylinders and said ferrule opening is perpendicular to said first set of half cylinders;

wherein said outwardly extending header wall and said outwardly extending tank wall mate to form a mating edge for said header and said tank; and wherein said second set of half cylinders is configured to mate with said first set of half cylinders upon coupling of said tank on top of said header to form a set of complete cylinders.

2. The two piece heat exchanger manifold of claim 1 wherein said upwardly extending wall consists of a plurality of regularly spaced communication ports.

3. The two piece heat exchanger manifold of claim 2 wherein said communication ports are in a form of mounds wherein a channel is defined between said mounds.

4. The two piece heat exchanger manifold of claim 3 wherein said ferrule opening coincides with said channel.

5. The two piece heat exchanger manifold of claim 1 wherein said ferrule opening is formed at a base of said third set of half cylinders.

6. The two piece heat exchanger manifold of claim 1 wherein said tank comprises an integral crimping flange extending outwardly and downwardly from said outwardly extending tank wall.

7. The two piece heat exchanger manifold of claim 6 wherein said crimping flange comprises a curved wall and a flat wall wherein said flat wall is parallel to said outwardly extending tank wall.

8. The two piece heat exchanger manifold of claim 1 wherein said header and said tank further comprise an integral port wherein said port extends outwardly from said outwardly extending header wall and tank wall, said integral port being parallel to a longitudinal axis of said header and said tank.

9. The two piece heat exchanger manifold of claim 8 wherein said integral port is formed by assembling a first half cylinder integrally formed on said outwardly extending header wall and a second half cylinder integrally formed on said outwardly extending tank wall.

10. A two piece heat exchanger manifold comprising:

a header wherein said header is formed of first set of half cylinders joined by a flat wall, a communication port formed at regular intervals on said flat wall and a single ferrule opening coinciding with said communication ports; wherein said ferrule opening is perpendicular to the first set of half cylinders;

an outwardly extending header wall surrounding said first set of half cylinders;

a tank aligned on top of said header wherein said tank is formed of a second set of half cylinders;

an outwardly extending tank wall surrounding said second set of half cylinders;

wherein said second set of half cylinders are configured to mate with said first set of half cylinders upon assembly of said header with said tank to form a set of complete cylinders; and an integral port parallel to a longitudinal axis of said header and said tank wherein said integral port extends outwardly from said outwardly extending header wall and said outwardly extending tank wall.

11. The two piece heat exchanger manifold of claim 10 wherein said communication ports are in a form of mounds wherein a channel is defined between said mounds.

12. The two piece heat exchanger manifold of claim 10 wherein said header further comprises a third set of half cylinders perpendicular to and intercepting said first set of half cylinders.

13. The two piece heat exchanger manifold of claim 10 wherein said tank further comprises an integral crimping mechanism formed on said outwardly extending tank wall.

14. The two piece heat exchanger manifold of claim 13 wherein said crimping mechanism comprises a curved wall, and a flat wall wherein said flat wall is parallel to said outwardly extending tank wall.

15. The two piece heat exchanger manifold of claim 10 wherein said integral port is formed by mating a half cylinder formed on said outwardly extending header wall with a half cylinder formed on said outwardly extending tank wall.

16. A method of assembling a heat exchanger to be used in an vehicle said method comprising the steps of:

providing a header, said header comprising a first set of half cylinders, a second set of half cylinders perpendicular to and intercepting said first set of half cylinders, a set of communication ports formed between said first set of half cylinders, a single ferrule opening formed on a base of said second set of half cylinders, coinciding with one of said communication ports wherein said ferrule opening extends substantially the length of said second set of half cylinders;

providing a tank, said tank comprising a third set of half cylinders with an integral crimping mechanism; and aligning said tank on top of said header wherein said third set of half cylinders are configured to mate with said first set of half cylinders to form complete cylinders.

17. The method of claim 16 further comprising the steps of:

inserting a set of heat exchanger tubes through said ferrule openings, and brazing said header, said tank and said heat exchanger tubes in a brazing medium at a fixed temperature.

* * * * *

UNITED STATES PATENT AND TRADEMARK OFFICE

CERTIFICATE OF CORRECTION

PATENT NO. : 6,640,887 B2
DATED : November 4, 2003
INVENTOR(S) : Bradley D. Abell et al.

It is certified that error appears in the above-identified patent and that said Letters Patent is hereby corrected as shown below:

Column 6,
Line 40, immediately after "ports" delete ";" (semicolon) and substitute -- , -- (comma) in its place.

Column 8,
Line 11, immediately after "openings" delete "," (comma) and substitute -- ; -- (semicolon) in its place.

Signed and Sealed this

Third Day of February, 2004

JON W. DUDAS
*Acting Director of the United States Patent and Trademark Office*